US008734610B2

(12) United States Patent
Shin et al.

(10) Patent No.: US 8,734,610 B2
(45) Date of Patent: May 27, 2014

(54) TWO VESSEL REACTOR SYSTEM AND METHOD FOR HYDROLYSIS AND DIGESTION OF WOOD CHIPS WITH CHEMICAL ENHANCED WASH METHOD

(75) Inventors: Namhee Shin, Clifton Park, NY (US); C. Bertil Stromberg, Diamond Point, NY (US); Ventzislav H Kirov, Lake Bluff, IL (US); William J. Cann, Carol Stream, IL (US)

(73) Assignee: Andritz Inc., Glen Falls, NY (US)

( * ) Notice: Subject to any disclaimer, the term of this patent is extended or adjusted under 35 U.S.C. 154(b) by 501 days.

(21) Appl. No.: 12/114,856

(22) Filed: May 5, 2008

(65) Prior Publication Data

US 2008/0302492 A1 Dec. 11, 2008

Related U.S. Application Data

(60) Provisional application No. 60/939,718, filed on May 23, 2007.

(51) Int. Cl.
*D21C 1/02* (2006.01)
*D21C 3/02* (2006.01)

(52) U.S. Cl.
CPC ... *D21C 1/02* (2013.01); *D21C 3/02* (2013.01)
USPC ..... 162/19

(58) Field of Classification Search
CPC ..... D21C 1/02; D21C 3/02; D21C 3/022; D21C 3/26; D21C 1/04
USPC ..... 162/19
See application file for complete search history.

(56) References Cited

U.S. PATENT DOCUMENTS 3,632,469 A * 1/1972 Wilder ..... 162/25
4,436,586 A * 3/1984 Elmore ..... 162/19
6,841,042 B2 * 1/2005 Stromberg et al. ..... 162/237

FOREIGN PATENT DOCUMENTS

WO 2007/051269 5/2007

OTHER PUBLICATIONS

Headley, Pulp Cooking Developments Focus on Fiber Yield, Lower Chemical Use, Oct. 1996, Pulp and Paper, 70 (10), whole document.*
Rydholm, Pulping Processes, 1965, Interscience Publishers, p. 663-671.*

* cited by examiner

*Primary Examiner* — Anthony Calandra
(74) *Attorney, Agent, or Firm* — Nixon & Vanderhye P.C.

(57) ABSTRACT

A reactor vessel system including: a first reactor vessel having a hydrolysate and liquid extraction screen, a first region above the extraction screen that is maintained at conditions promoting a hydrolysis reaction in the cellulosic material, a second region below the extraction screen in which the hydrolysis is substantially suppressed and a wash liquid inlet below the extraction screen providing wash liquid at a temperature below a hydrolysis temperature; a transport pipe having an inlet coupled to the first reactor vessel and an outlet coupled to a second reactor vessel, and the second reactor vessel includes a liquid discharge that extracts a portion of liquid from the second reactor vessel and directs the portion of liquid to the first reactor vessel or to the transport pipe.

18 Claims, 1 Drawing Sheet

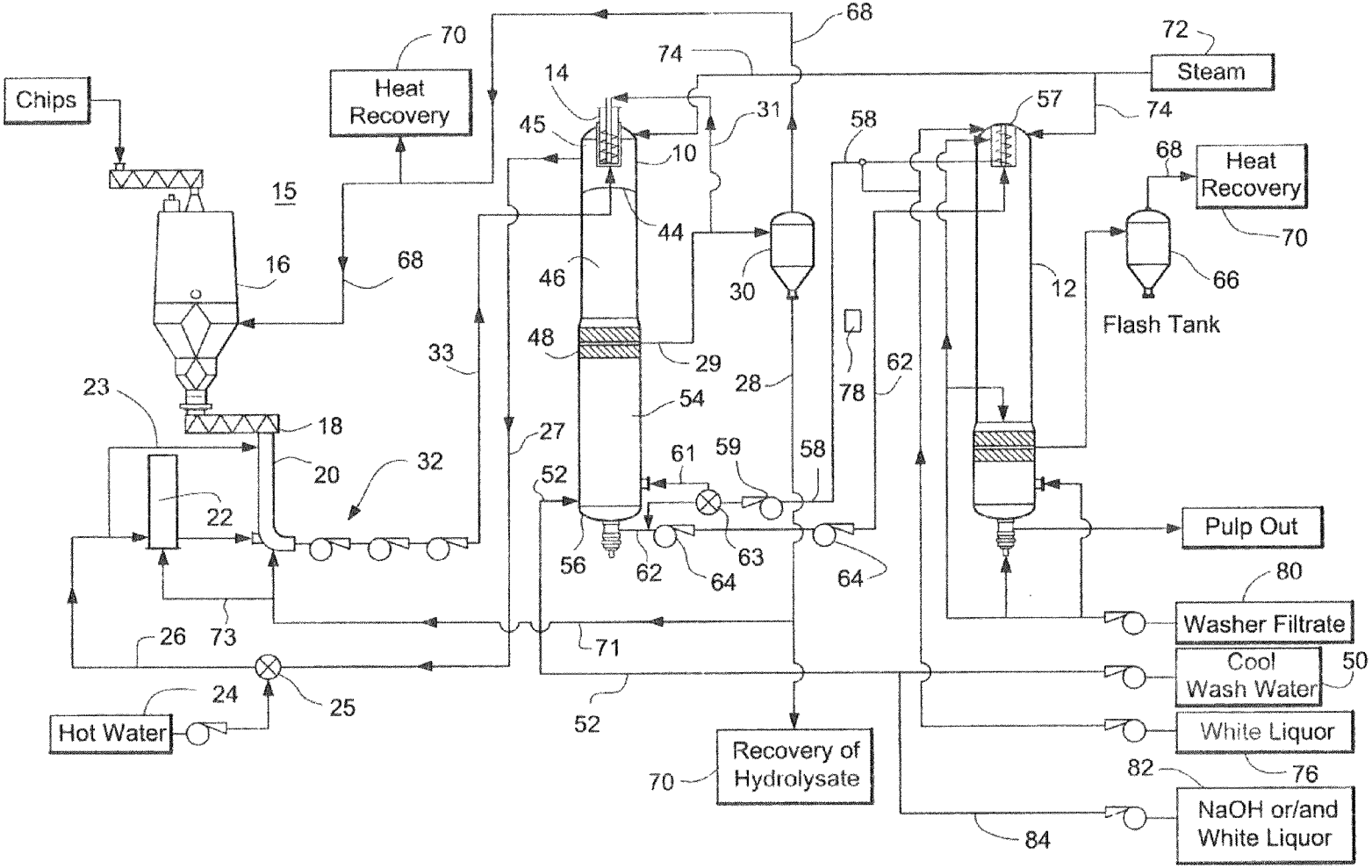
Steam
Heat Recovery
Flash Tank
Pulp Out
Washer Filtrate
Cool Wash Water
White Liquor
NaOH or/and White Liquor
Recovery of Hydrolysate
Heat Recovery
Chips
Hot Water

TWO VESSEL REACTOR SYSTEM AND METHOD FOR HYDROLYSIS AND DIGESTION OF WOOD CHIPS WITH CHEMICAL ENHANCED WASH METHOD

RELATED APPLICATION

This application claims the benefit of U.S. Provisional Application Ser. No. 60/939,718 filed May 23, 2007, the entirety of which application is incorporated by reference.

BACKGROUND OF THE INVENTION

This invention relates to a method and an apparatus for hydrolysis treatment of cellulosic fiber material.

In conventional systems, wood chips (or other cellulosic or fiber material) undergo hydrolysis in a first reactor vessel prior to introduction to a second vessel, e.g., a digester. One such conventional system is described in U.S. Pat. No. 4,174,997 ('997 patent). In the first reactor vessel, hydrolysis of the slurry of wood chips passing through that vessel occurs under acidic conditions. In the first reactor vessel, hydrolysate, e.g., sugars such pentose and hexose, is extracted from wood chips and the hydrolysate is recovered. Fiber material is discharged from the bottom of the first reactor vessel and transferred via the transfer line to the top of the second reactor vessel, e.g., digester, for cooking treatment of the cellulosic material.

In conventional systems, such as described in the '997 patent, hydrolysis occurs throughout the first reactor vessel. A chip slurry is introduced into the top of the first reactor vessel and is discharged from the bottom of the vessel. Heat is added to the vessel by introducing hot water, e.g., 150° C. degrees Celsius (° C.), to the bottom of the vessel and steam at the top of the vessel. In addition, acidic solutions were added to promote hydrolysis, especially where the material was at temperatures below 150° C. The hot water flows upward in the vessel, which is counter to the downward flow of fiber material. The hot water and steam provide sufficient heat to the material to maintain hydrolysis through the vessel.

In some conventional systems, cooking chemical such as white liquor, is introduced to the bottom of the first reactor vessel and into a transfer pipe for transporting the chip slurry from the first reactor vessel to the second reactor vessel. The injection of cooking chemicals to the bottom of the first reactor vessel starts the impregnation of the fibers of the cellulosic material in the bottom of the first reactor vessel while the hydrolysis reaction is still underway. It is undesirable to introduce cooking chemicals to the cellulosic material while hydrolysis is ongoing.

BRIEF DESCRIPTION OF THE INVENTION

A novel hydrolysis system has been developed for a pulping system. Cellulosic material, e.g., wood chips, undergo hydrolysis in an upper region of a first vessel (hydrolysis reactor). Hydrolysis is preferably conducted where the material in the vessel is at a temperature of between 150° C. and 175° C., more between 160° C. to 170° C. Hydrolysis is preferably conducted where the material in the vessel is preferably at a pH of 1 to 6, and more preferably at a pH 3 to 4. Hydrolysate and liquids are removed from the hydrolysis reactor through an extraction screen.

Below the extraction screen, cool wash liquid flows upward through a wash zone in the hydrolysis reactor and to the extraction screen. The cool wash liquid suppresses hydrolysis reactions in the cellulosic material below the extraction screen. Substantially all of the hydrolysis is preferably performed above the extraction screen in the hydrolysis reactor. The cool wash liquid preferably has a temperature of 10° C. to 70° C. cooler than the hydrolysis temperature, more preferably 20° C. to 50° C. cooler, and most preferably 25° C. to 35° C. cooler than the hydrolysis temperature. The cool wash liquid preferably has a pH of 3 to 7, and most preferably a pH of 4 to 5. Further the cool wash liquid preferably includes mostly water and may include an added chemical in an amount of 0.01 percent (%) to 5 percent of the amount of cellulosic material, e.g. wood, in the slurry flowing through the vessel. The amount of added chemical is most preferably 0.1 percent to 1 percent of the amount of cellulosic material in the slurry. The chemical added to the cool wash water may be either or both sodium hydroxide (NaOH) or essentially sulfur free white liquor to produce a cool wash liquid.

A reactor vessel system has been developed comprising: a first reactor vessel having a material input receiving cellulosic material and a material discharge for the cellulosic material, wherein the cellulosic material flows through the first reactor vessel from the material input to the material discharge; a hydrolysate and liquid extraction screen in the first reactor vessel; a first region of the first reactor vessel between the material input and the liquid extraction screen, wherein the first region is maintained at conditions promoting a hydrolysis reaction in the cellulosic material; a heat energy inlet port for introducing a heated fluid added to the cellulosic material in or above the first region; a second region of the first reactor vessel between the liquid extraction screen and the material discharge in which the hydrolysis is substantially suppressed; a wash liquid inlet port for introducing a wash liquid below the extraction screen and flowing through the second region to the extraction screen, wherein the wash liquid is introduced at a temperature below a hydrolysis temperature and the wash liquid suppresses the hydrolysis second region; a transport pipe having an inlet coupled to the material discharge of the first reactor vessel and an outlet coupled to a second reactor vessel, wherein the cellulosic material flows from the material discharge, through the transport pipe to the second reactor vessel, and the second reactor vessel applies a cooking liquor to the cellulosic material in the second reactor vessel, and the second reactor vessel includes a liquid discharge that extracts a portion of liquid from the second reactor vessel and directs the portion of liquid to at least one of a lower inlet of the first reactor vessel or to the transport pipe.

A flash tank may receive liquid extracted from the extraction screen(s) of the first reactor vessel and provide steam to the vessel at or above the first vessel region. The flash tank may also discharge hydrolysate to a hydrolysate recovery system.

A reactor vessel system has been developed comprising: first reactor vessel having an upper material input receiving cellulosic material and a bottom material discharge for the cellulosic material, wherein the cellulosic material flows through the first reactor vessel from the material input to the material discharge; a hydrolysate and liquid extraction screen in the first reactor vessel; an upper region of the first reactor vessel between the material input and the liquid extraction screen, wherein the upper region is maintained at or above a hydrolysis temperature at which a hydrolysis reaction occurs in the cellulosic material; a heat energy inlet port for introducing a heated fluid to the cellulosic material in the upper region of the first reactor vessel; a lower region of the first reactor vessel between the liquid extraction screen and the bottom material discharge in which the hydrolysis is substantially suppressed; a wash liquid inlet port at a lower region of the first reactor vessel for introducing sufficient wash liquid to the vessel such that the wash liquid flows up through the lower region to the extraction screen, wherein the wash liquid is introduced at a temperature below the hydrolysis temperature and the wash liquid cools and suppresses the hydrolysis reactions in the second region of the reactor vessel; a transport pipe having an inlet coupled to the material discharge of the first reactor vessel and an outlet coupled to a second reactor vessel, wherein the cellulosic material flows from the bottom material discharge, through the transport pipe to an upper inlet of the second reactor vessel, and the second reactor vessel applies a cooking liquor to the cellulosic material in the second reactor vessel, and the second reactor vessel includes a liquid discharge that extracts a portion of liquid from the second reactor vessel and directs the portion of liquid to at least one of a lower inlet of the first reactor vessel or to the transport pipe.

A processing system has been developed for converting cellulosic material to pulp, the system comprising: a first pressurized reactor vessel operating at a pressure above atmospheric pressure, the first reactor vessel including a material input receiving cellulosic material and a material discharge for the material, wherein the cellulosic material flows from the material input to the material discharge, a heat energy input port in an upper portion of the first reactor vessel, a first region of the first reactor vessel between the material input and a liquid extraction screen, wherein the first region is maintained at a hydrolysis temperature of at least 170 degrees Celsius in the cellulosic material, the extraction screen having an outlet for extracting hydrolysate and liquid from the first vessel, and a second region of the first reactor between the liquid extraction screen and the discharge in which a temperature is below the hydrolysis temperature and the hydrolysis reactor is substantially suppressed and a discharge of the first vessel below the second region; the processing system further comprises a transport pipe providing a flow conduit from the discharge to a continuous digesting vessel, and the continuous digesting vessel receives the cellulosic material discharged from the first reactor vessel.

A method has been developed to produce pulp from cellulosic material comprising: introducing cellulosic material to an upper inlet in a first reactor vessel; hydrolyzing the cellulosic material in upper region of the an upper region of the first reactor vessel by adding pressure and heat energy to the vessel; extracting hydrolysate from the cellulosic material through an extraction screen below the upper region and in the first reactor vessel; introducing a wash liquid to a lower region of the first reactor vessel where the wash liquid suppresses hydrolysis of the cellulosic material in the lower region and said wash liquid flows upward through the cellulosic material to the extraction screen; discharging the cellulosic material from a lower outlet of the first reactor vessel; introducing the discharged cellulosic material to a second reactor vessel, and introducing cooking liquor into the top of the second reactor vessel to digest the cellulosic material to produce pulp.

A method has been developed to suppress hydrolysis of cellulosic material comprising: introducing cellulosic material in an upper inlet of a first reactor vessel, wherein the material moves downwardly through the vessel; adding steam at above atmospheric pressure to the first reactor vessel; maintaining at above a hydrolysis temperature the cellulosic material in an upper region of the first reactor vessel; extracting hydrolysate from the cellulosic material through an extraction screen below the upper region in the first reactor vessel; cooling the cellulosic material below the extraction screen to a temperature below the hydrolysis temperature, and discharging the cellulosic material from a bottom outlet of the first reactor vessel.

BRIEF DESCRIPTION OF THE DRAWING

FIG. 1 is a schematic diagram of a continuous pulping system having a chip feed, hydrolysis reactor and a continuous digester reactor.

DETAILED DESCRIPTION OF THE INVENTION

In a two reactor vessel system, steam is introduced to the top of both vessels for heating and pressurizing purposes. Hydrolysis occurs above extraction screens in the top of the first reactor vessel. The extraction screens in the first reactor vessel remove hydrolysate as the wood chips or other cellulosic or fiber material (collectively referred to cellulosic material) introduced at the top of the first vessel progress through the vessel and to a lower extraction port of that vessel.

The cellulosic material is washed in the first reactor vessel below the extraction screens. Wash liquid is introduced at the bottom of the first reactor vessel and flows upwards to the extraction screens. The wash liquid may be water only or water mixed with one or more chemicals, such as sodium hydroxide (NaOH) and essentially sulfur free white liquor. The diameter of the first vessel may be uniform above and below the extraction screen. The cellulosic material discharged from the extraction port of the first reactor vessel is introduced to the top of the second reactor vessel, which may be a digester vessel. The cellulosic material is cooked in the second reactor vessel to generate pulp that is discharged from a lower extraction port of the second reactor vessel.

In the first reactor vessel, the cellulosic material is washed in a lower section of the vessel to remove hydrolysate from the material. The washing in the lower portion of the first vessel is performed with wash liquid at a temperature below the hydrolysis temperature. The wash liquid temperature is preferably 10° C. to 70° C. cooler than the hydrolysis temperature, more preferably 20° C. to 50° C. cooler, and most preferably 25° C. to 35° C. cooler than the hydrolysis temperature. The wash liquid cools the cellulosic material to a temperature normal hydrolysis temperatures. The cool wash liquid flushes out remaining hydrolysate from the cellulosic material, lowers the temperature of the cellulosic material to below the hydrolysis temperature, and adjusts the pH of the cellulosic material to near or slightly above neutral (7 pH) in the first reactor vessel and prior to cooking of the material in the second reactor vessel.

The cool wash liquid preferably has a pH of 3 to 7, and more preferably a pH of 4 to 5. Keeping the pH of the cool wash liquid in these ranges prevents or minimizes the precipitation of dissolved lignin in the cooking chemicals of the second reactor vessel. The wash liquid may include added chemicals, e.g., NaOH and essentially sulfur free white liquor, to increase the amount of hydrolysate extracted from the cellulosic material in the first vessel. Introducing wash liquid, rather than a large amount of white liquor to the bottom of the first reactor vessel, reduces lignin precipitation in the first vessel that might otherwise occur if larger amounts of white liquor were added to the bottom of the first reactor vessel.

The second reactor vessel may be a continuous digester vessel, such as a vapor or steam phase digester. The use of a vapor or steam phase digester should avoid operating problems in the top of the second reactor vessel, caused by gas formation during the hydrolysis. The first and second reactor vessels may be substantially vertical, have a height of at least 100 feet, an inlet in an upper section of the vessel, and a discharge proximate a bottom of the vessel. Heat energy added to the reactor vessels may be pressurized steam at above atmospheric pressure.

FIG. 1 is a schematic diagram of an exemplary chip feed and pulp processing system having a first reactor vessel 10 (hydrolysis reactor) and a second reactor vessel 12, e.g., a continuous pulp digester. The first reactor vessel includes an inverted top separator 14 that receives a slurry of cellulosic material and liquid from a conventional chip feed assembly 15 via chip feed line 33.

The chip feed assembly 15 may include a wood chip bin 16, such as the Diamondback® Chip Bin sold by Andritz Inc., connected to a double screw chip meter 18 and a chip chute 20. Hot water 24 is added via pipe 26 to the chips or other cellulosic material in the chip chute 20 to form a slurry of cellulosic material. A liquid surge tank 22 supplies the water to the chip tube. Water may also be supplied directly to the chip tube through pipe 23.

Separated liquid discharged from the top separator 14 and extracted to pipe 27 may be mixed (see valve 25) with hot water. The mixture flows through pipe 26 to the surge tank 22 and, via pipe 23, to the chip tube 20. The mixture of liquid discharged from the top separator 14 and hot water 24 is controlled, using valve 25, to be at a temperature lower than the normal hydrolysis temperature, e.g., preferably 170° C., of the cellulosic material. The temperature of the water and liquid discharged from the top separator is preferably in a range of 100° Celsius (C.) to 120° C. By temporarily storing the mixture of water and liquor from the top separator, the surge tank 22 may be used to provide temperature control of the mixture of water and liquid used to form the slurry of cellulosic material. For example, temperature control may be provided by adjusting the relative amounts in the surge tank of liquid flowing via pipe 27 from the top separator to the surge tank and hot water 24.

To feed chips to the first reactor vessel, the slurry of cellulosic material is pumped via one or more pumps 32 (such as the TurboFeed® System as sold by Andritz Inc., and pumps described in U.S. Pat. Nos. 5,752,075; 6,106,668; 6,325,890; 6,551,462; 6,336,993 and 6,841,042) to the top separator 14 of the first reactor vessel. Other slurry feed systems, such as those using a high-pressure feeders, may also be suitable.

The first reactor vessel 10 may be controlled based on either or both the pressure and temperature in the vessel. Pressure control may be by use of a controlled flow of steam via steam pipe 74 or in addition an inert gas added to the first reactor vessel. A gaseous upper region 45 in the first reactor vessel is above an upper level 44 of the chip column.

The pressure from the gaseous phases assists in forcing the cellulosic fiber material down and out of the vessel at the bottom 56 discharge of the first vessel. The latent pressure plus hydrostatic head should be higher in the first reactor vessel 10 than in the second reactor vessel 12 to assist in transporting the cellulosic material discharged from the first reactor vessel to the second reactor vessel. If the latent pressure and hydrostatic head is greater in the second reactor vessel, a chip pump may be used between the two vessels to pump material from the first vessel to the second vessel.

Steam 72 is supplied at a temperature above the normal hydrolysis temperature, e.g., 170° C., to enable hydrolysis to occur in the cellulosic slurry in the first reactor vessel. The steam is added in a controlled manner that, at least in part, promotes hydrolysis in the first reactor vessel. The steam is added via lines 74 and 68 at or near the top of the first reactor vessel, such as to the vapor phase 45 of the vessel. The steam introduced to the first reactor vessel elevates the temperature of the cellulosic slurry to at or above the normal hydrolysis temperature, e.g., above 150° C.

The cellulosic material slurry fed to the inverted top separator 14 in the first reactor vessel may have excessive amounts of liquid to facilitate flow through the transport pipe 33. Once in the vessel, the excess liquid is removed as the slurry passes through the top separator 14. The excess liquid removed from the separator is returned via pipe 27 to the chip feed system, e.g., to the chip tube 20, and reintroduced to the slurry to transport the cellulosic material to the top of the first vessel. Hot liquid may be added at or near the top separator 14 and gas phase 45 of the first reactor vessel. The added liquid may be hot water 24 (piping not shown) or hot liquid extracted from the extraction screen 48 in the first reactor vessel and flowing through pipe 31 to the top of the first reactor vessel.

The top separator 14 discharges chips or other solid cellulosic material to a liquid phase (below upper chip column 44) of the first reactor vessel. The top separator pushes, e.g., by a rotating vertical screw, the material from the top of the inverted separator 14 and into the gas phase. The pushed out material may fall through a gas phase 45 in the vessel and to the upper chip column 44 of cellulosic material and liquid contained in the first reactor vessel. The temperature in the gas phase (if there is such a phase) and in upper region of the first reactor vessel 10 is at or above the normal hydrolysis temperature, e.g., at or above 170° C. The slurry of cellulosic material gradually flows down through the first reactor vessel. As the material progresses through the vessel, new cellulosic material and liquid are added to the upper surface from the top separator.

Hydrolysis occurs in the upper region 46 of the first reactor vessel 10, where the temperature is maintained at or above the normal hydrolysis temperature. The hydrolysis will occur at lower temperature, e.g., below 150° C., by the addition of acid, but preferably hydrolysis occurs at high temperatures, above 150° C. to 170° C., using only water and recirculated liquid from the top separator of the first reactor vessel. Hydrolysis should occur substantially only in the upper region 46 above an extraction screen 48 or above a set of multiple elevations of extraction screens 48.

To stop hydrolysis as the cellulosic material moves downward through the vessel 10 past the extraction screen 48, the temperature of the material is reduced to below the hydrolysis temperature or acid in the cellulosic material is removed from the first reaction vessel through the extraction screens 48. Reducing the temperature and removing acids from the cellulosic material may be used together or separately to suppress and preferably stop hydrolysis.

Hydrolysate is a product of hydrolysis. The hydrolysate is removed with wash liquid and some other liquids through the extraction screens 48 and fed to pipe 29 and flows to the flash tank 30. The hydrolysate, wash liquid and other extracted liquids may be recovered or recirculated to the chip feed system. The liquid in pipe 29 extracted from the first reactor vessel 10 and directed to a flash tank 30 includes hydrolysate extracted from the first reactor vessel. The flash tank 30 separates the hydrolysate laden liquid from steam. The liquid from the flash tank is preferably at a temperature below a hydrolysis temperature and more preferably below 110° C. The liquid with hydrolysate flows from the flash tank to pipe 28 and the steam may be returned via pipe 68 to an upper gaseous phase of the first reactor vessel 10. A portion of the hydrolysate is recovered by a conventional hydrolysate recovery system 70.

The steam 68 may be introduced to the vessel, especially if the pressure in the vessel is lower than in the flash tank. If the pressure of the vessel is not lower than the flash tank, the steam may be directed to a chip bin, a heater for water and/or white liquor to be used in the process. Similar circulations of steam and/or extracted liquids are described in U.S. Pat. No. 7,105,106 and US Patent Publication 2007-0000626.

The liquids from the flash tank 30, including a portion of the hydrolysate flows through pipes 28, 71 to the chip slurry in the chip tube 20 and, via pipe 73, to the liquid surge tank 22. The amount of liquids with hydrolysate added to the chip slurry in the chip chute 20 may be controlled to avoid excessive changes to the pH of the chip slurry, e.g., to avoid making the slurry excessively alkaline or excessively acidic. The addition of liquid to the cellulosic material in the chip tube 20 assists in conveying the chip slurry material through the chip pumps 32 and through the chip slurry pipes 33 extending between the chip chute 20 and the top separator 14 of the first reactor vessel 10.

A counter-current wash zone 54 is in the vessel 10 below the extraction screens 48. The wash zone 54 is a lower region of the vessel 10 below the extraction screen 48 and above the vessel bottom 56. The wash liquid 50 flowing through the wash zone cools the cellulosic material flowing through the wash zone to eliminate or at least minimize continuing hydrolysis of the downwardly moving chip stream in the wash zone 54. The wash liquid is preferably 10° C. to 70° C. cooler than the hydrolysis temperature, more preferably 20° C. to 50° C. cooler, and most preferably 25° C. to 35° C. cooler.

The wash liquid 50 flows in a counter flow direction, e.g., an upward flow, to the downward flow of cellulosic material in the first reactor vessel. The cool wash liquid 50 is pumped to the bottom of wash zone from pipe 52 which connects to the bottom of the first reactor vessel 10. The wash liquid pressure in pipe 52 is sufficient to cause the wash liquid to flow upward (see arrow designed 50) through the first reactor vessel 10 in a counter-flow to the direction of cellulosic material flowing downward through the vessel. The wash liquid is removed at the extraction screen 48.

Chemicals 82, such as NaOH or essentially sulfur free white liquor, may be added via pipe 84 to the cool wash water flowing through pipe 52 prior to introduction to the bottom of the vessel 10. The amount of the added chemicals in the wash liquid may be an amount of 0.01 percent (%) to 5 percent of the amount of cellulosic material, e.g. wood, in the slurry flowing through the vessel. The amount of added chemicals is preferably 0.1 percent to 1 percent of the cellulosic material. The chemical(s) are added to the wash water to suppress hydrolysis and remove hydrolysate, and optionally to adjust the pH of the wash liquid. The addition of the chemicals to the wash water results in substantially more hydrolysate being extracted from the cellulosic material flowing through the wash zone, that would occur if the wash liquid was purely water.

As the wash liquid 50 interacts with the cellulosic material in the wash zone and at or just above the extraction screen 48, the liquid cools the cellulosic material to below the hydrolysis temperature and washes some chemicals out of the material. Preferably, the cool wash liquid, reduces the temperature of the cellulosic material near the extraction screens 48 and in the wash zone 54 to suppress and stop hydrolysis reactions in the material. In addition, as the hydrolyzed cellulosic material moves below the extraction screens 48, it is preferred that the material be at a pH level at which lignin does not dissolve. The amount of wash liquid and the chemicals in the wash liquid may be adjusted to cause the pH level of the cellulosic material in the wash zone 54 to be within a predetermined pH range.

The washed chips are discharged through the bottom 56 of the first reactor vessel and sent via chip transport pipe 62 to the top separator 57, e.g., an inverted top separator, of the second reactor vessel 12, such as a continuous digester. A pump 64 is optionally used to assist in the transport of the cellulosic material through pipe 62 from the first reactor vessel to the second reactor vessel. Water and other liquids remaining in the chips may be used to increase the liquid to chip ratio in the cellulosic material flowing through pipe 62 to assist in the transport of material through the pipe 62 and to the top separator 56 of the second reactor vessel.

Additional liquid, from pipe 58, may be added to the cellulosic material slurry in the transport pipe 62 or to the bottom of the first reactor vessel through pipe 61. The additional liquid may be extracted from the top separator 57 of the second reactor vessel 12. The additional liquid may be recirculated by pumping (via pump 59) and via pipes 58 and 61 to the bottom 56 of the first vessel. The liquid in line 58 may be introduced directly into the discharged stream of cellulosic material in pipe 62 or via pipe 61 into the bottom 56 of the first reactor vessel as part of the liquid used to assist in the discharge of the chips form the first vessel. A valve 63 directs liquid flow from pump 59 and pipe 58 to pipe 61 or transport pipe 62. The liquid recirculated from the top separator 57 of the second vessel should be relatively free of alkaline materials and the pH control may regulated to ensure that the recirculated liquid has an acceptable pH level before being introduced into bottom of the first reactor vessel 10 or transport pipe 62.

Acid may be added to the circulation pipe 62 to assist in pH control of the cellulosic material being transported from the first reactor vessel to the second reactor vessel. If the pH of the cellulosic material in the chip transport pipe 62 is above a desired pH level, the addition of an acidic chemical into the pipe 62 or to the bottom 56 of the first reactor vessel may be used to decrease the pH in the cellulosic material.

A pH monitor 78 may be used to sense the pH level of the cellulosic material flowing from the first reactor vessel to the second reactor vessel. If the monitor 78 detects a pH level in the cellulosic material above a desired pH range, a controller may cause an acidic chemical to be added to the cellulosic material in bottom 56 of the first vessel 10 or in the transport pipe 62. Additionally, if the monitor 78 detects a pH level above the desired pH range, the controller may cause additional wash water to be introduced into the bottom 56 of the first vessel or to the pipe 62.

Steam from the flash tanks 30, 66 may be may be conveyed may be used, via pipe 68, to add heat to any of the chip feed system 16, the first reactor vessel and a heat recovery system 90. For example, the steam extracted from the first reactor vessel 10 may be added to the chip bin 16 to assist in the production of the slurry of cellulosic material and for controlling the liquid to wood ratio in the slurry. Before adding the steam to the chip feed system, the steam may be checked to confirm that it is substantially free of sulfur. Preferably, no sulfur containing chemical is added to the cellulosic material or to any other material or liquid introduced into the first reactor vessel 10. Sulfur in the first reactor vessel 10 could undesirably result in sulfur compounds in the vessels 10, 12 and in liquids extracted from the extraction screen 48.

Additional steam 72 may be added via pipe 74 to the tops of the first reactor vessel 10 and to the top of the second reactor vessel 12. The additional steam may provide heat energy for the reactor vessels.

Cooking chemicals, e.g., white liquor 76, are added to the top, e.g., to an inverted top separator 57 of the second reactor vessel 12. A portion of these cooking chemicals may be introduced to the circulation line 58 extracting liquor from the top separator 57 and adding liquor to the bottom of the first reactor vessel or to the chip transport line 62. White liquor 76 is added to the top separator of the second reactor vessel 12 to promote mixing of liquor with the cellulosic material in the separator and before the mixture of material and liquor is discharged from the separator to the second reactor vessel.

Monitoring of circulation line 58 may be useful, including a pH monitor, to confirm that cooking chemicals do not flow from the second reactor vessel 12 to the first reactor vessel 10 or to the transport pipe 62. The pH in the circulation line 58 should remain in the range of 4 pH to 10 pH, preferably in a range of 6 pH to 10 pH, and more preferably a range of 6 pH to 8 pH. If the pH in the circulation line 58 is high, additional cool wash water 50 may be added to the bottom 56 of the first reactor vessel or to the transport line 62. The wash water 50 may be added to the bottom of the first reactor vessel or the transport line 62 to assist in pushing the slurry cellulosic material from the first vessel to the top of the second reactor vessel.

The second reactor vessel 12 may be a pressurized gas phase continuous digester vessel. The liquid level in the second reactor vessel is below the gas phase in the vessel and is sufficient to entirely submerge the solids, e.g., chips, of the cellulosic material. The liquid level in the second reactor vessel may be as high as the upper rim of the top separator 57. This high liquid level may be helpful to provide a quick and thorough penetration of cooking chemicals into the chips. Cooking in the second vessel is co-current.

The second reactor vessel 12, e.g., a cooking or digesting vessel, may be a single vessel system with multiple stages where the cellulosic material passing through the first stage (upper elevation) is at a lower temperature than the cellulosic material at other stages (lower elevations). An optional cooking or digester operation employs cooking the cellulosic material as soon as the chips are introduced into the cooking liquor. Yet another optional cooking or digester operation is cooking the cellulosic material as it is introduced to the cooking liquor and cooking the material at different temperatures as the cooking process proceeds through the second reactor vessel. For example, the second reactor vessel may have multiple cooking zones at different elevations and each zone is maintained at a different cooking temperature.

Heat recovery systems 90 and methods are conventional and well know in pulping plants. For example heat from the circulation streams, such as from the flash tanks 66, may be recovered in heat exchangers or other such heat recovery systems 90. The recovered heat from the flash tanks may also be applied to pre-heat liquid, such as wash filtrate 80 and white liquor 76, introduced to the top of the second reactor vessel. This pre-heating of liquids may be accomplished by using heat exchangers to extract heat from the flash tanks and transfer the heat to the liquids.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to produce pulp from cellulosic material comprising:

adding a liquid to a cellulosic material to form a slurry of the cellulosic material, wherein the liquid is at least one of water and a liquid extracted from an upper inlet of a first reactor vessel, and the liquid to the cellulosic material is substantially devoid of an acid;

pumping the slurry of cellulosic material to the upper inlet in the first reactor vessel;

hydrolyzing the cellulosic material in an upper region of the first reactor vessel by adding pressure and heat energy to the vessel, wherein the hydrolysis is conducted at a temperature of at least 150 degrees Celsius;

extracting hydrolysate from the cellulosic material through an extraction screen below the upper region and in the first reactor vessel;

introducing a wash liquid to a lower region of the first reactor vessel where the wash liquid suppresses hydrolysis of the cellulosic material in the lower region and said wash liquid flows upward through the cellulosic material to the extraction screen, wherein the wash liquid as introduced to the lower region has an amount of alkali chemicals of no more than five percent of the amount of cellulosic material in the first reactor vessel;

discharging the cellulosic material from a lower outlet of the first reactor vessel;

introducing the discharged cellulosic material to a second reactor vessel;

introducing cooking liquor into an upper region of the second reactor vessel to digest the cellulosic material to produce pulp;

extracting liquor from the second reactor vessel and introducing the extracted liquor into the lower region of the first reactor vessel, and monitoring the pH of the extracted liquor and increasing a flow of wash liquid to the lower region if the monitored pH is above a predetermined pH level.

2. The method as in claim 1 wherein the wash liquid includes an amount of at least one of sodium hydroxide and white liquor substantially without sulfur in a range of 0.01 percent to 5 percent of the amount of cellulosic material flowing through the first reactor vessel.

3. The method as in claim 1 wherein the hydrolysis is conducted at a hydrolysis temperature in a range of 150° C. to 175° C.

4. The method as in claim 1 wherein the wash liquid is 10° C. to 70° C. cooler than the hydrolysis temperature.

5. The method as in claim 1 wherein the hydrolysis is conducted while the cellulosic material has a pH in a range of 1 to 6.

6. The method as in claim 1 wherein the wash liquid when introduced to the lower region has a pH in a range of 3 to 7.

7. The method as in claim 1 wherein the cellulosic material in the upper region is maintained at a temperature above a hydrolysis temperature to promote hydrolysis and the cellulosic material in the lower region is maintained at a temperature at least ten degrees Celsius below the hydrolysis temperature.

8. The method of claim 1 wherein the hydrolysis temperature is at least 170 degrees Celsius.

9. The method of claim 1 further comprising extracting liquor from the second reactor vessel and introducing the extracted liquor into the lower region of the first reactor vessel.

10. The method of claim 1 further comprising adding steam to the first reactor vessel to pressurize the vessel and add heat energy to the vessel.

11. The method of claim 1 wherein the wash liquid is a mixture of water and at least one of sodium hydroxide and white liquor substantially without sulfur, wherein the amount of the sodium hydroxide and white liquor is not more than five percent of the cellulosic material in the first reactor vessel.

12. A method to suppress hydrolysis of cellulosic material comprising:

introducing cellulosic material in an upper inlet of a first reactor vessel, wherein the material moves downwardly through the first reactor vessel;

adding steam at above atmospheric pressure to the first reactor vessel;

maintaining at above a hydrolysis temperature the cellulosic material in an upper region of the first reactor vessel, wherein the temperature of the cellulosic material is maintained at least at 150 degrees Celsius;

while the cellulosic material is at the temperature of at least 150 degrees, hydrolyzing the cellulosic material;

extracting hydrolysate from the cellulosic material through an extraction screen below the upper region in the first reactor vessel;

adding a wash liquid to cool the cellulosic material below the extraction screen to a temperature below the hydrolysis temperature, wherein the wash liquid is at least one of water and a liquid extracted from an upper inlet of a the first reactor vessel;

discharging the cellulosic material from a bottom outlet of the first reactor vessel to a second reactor vessel, wherein a cooking liquor is first introduced to the cellulosic material after the cooling of the cellulosic material to a temperature below the hydrolysis temperature;

extracting liquor from the second reactor vessel and introducing the extracted liquor to a lower region of the first reactor vessel, and monitoring the pH of the extracted liquor and increasing a flow of the wash liquid to the lower region if the monitored pH is above a predetermined pH level.

13. The method of claim 12 wherein cooling the cellulosic material includes introducing the wash liquid to the lower region of the first reactor vessel and flowing the wash liquid upward to the extraction screen.

14. The method of claim 12 wherein the wash liquid is a mixture of water and at least one of sodium hydroxide and white liquor substantially without sulfur.

15. The method of claim 12 wherein the amount of the sodium hydroxide and white liquor is not more than five percent of the amount or cellulosic material in the first reactor vessel.

16. The method of claim 12 wherein the hydrolysis temperature is at least 170 degrees Celsius.

17. The method of claim 12 further comprising adding steam to an upper region of the first reactor vessel to pressurize the vessel and add heat energy to the vessel.

18. A method to produce pulp from cellulosic material comprising:

adding a liquid to a cellulosic material to form a slurry of the cellulosic material, wherein the liquid is at least one of water and a liquid extracted from an upper inlet of a first reactor vessel, and the liquid to the cellulosic material is substantially devoid of an acid;

pumping the slurry of cellulosic material to the upper inlet in the first reactor vessel;

hydrolyzing the cellulosic material in an upper region of the first reactor vessel by adding pressure and heat energy to the vessel, wherein the hydrolysis is conducted at a temperature of at least 150 degrees Celsius, wherein the step of hydrolyzing the cellulosic material is performed without addition of an acid formed independently of the hydrolysis reaction to promote hydrolysis;

extracting hydrolysate from the cellulosic material through an extraction screen below the upper region and in the first reactor vessel;

introducing a wash liquid to a lower region of the first reactor vessel where the wash liquid suppresses hydrolysis of the cellulosic material in the lower region and said wash liquid flows upward through the cellulosic material to the extraction screen, wherein the wash liquid as introduced to the lower region has an amount of alkali chemicals of no more than five percent of the amount of cellulosic material in the first reactor vessel;

discharging the cellulosic material from a lower outlet of the first reactor vessel;

introducing the discharged cellulosic material to a second reactor vessel, and introducing cooking liquor into an upper region of the second reactor vessel to digest the cellulosic material to produce pulp, wherein the cooking liquor from the second reactor vessel is absent from the cellulosic material in the first reactor vessel.

* * * * *